US008884535B2

(12) United States Patent
Peng

(10) Patent No.: US 8,884,535 B2
(45) Date of Patent: Nov. 11, 2014

(54) LIGHT EMITTING DIODE CONTROL SYSTEM USING MODULATED SIGNALS

(71) Applicant: Semisilicon Technology Corp., New Taipei (TW)

(72) Inventor: Wen-Chi Peng, New Taipei (TW)

(73) Assignee: Semisilicon Technology Corp., New Taipei (TW)

( * ) Notice: Subject to any disclaimer, the term of this patent is extended or adjusted under 35 U.S.C. 154(b) by 97 days.

(21) Appl. No.: 13/689,466

(22) Filed: Nov. 29, 2012

(65) Prior Publication Data

US 2013/0169178 A1 Jul. 4, 2013

(30) Foreign Application Priority Data

Dec. 29, 2011 (TW) ..... 100224871 U

(51) Int. Cl.
*H05B 37/02* (2006.01)
*H05B 33/08* (2006.01)

(52) U.S. Cl.
CPC ..... *H05B 37/02* (2013.01); *H05B 33/0827* (2013.01)
USPC ..... 315/192; 315/307; 315/318

(58) Field of Classification Search
CPC .. H05B 37/029; H05B 37/0254; H05B 37/02; H05B 33/0803; H05B 33/0842; H05B 33/0863; H05B 33/0857
USPC ..... 315/192, 224, 250, 254, 246, 312, 317, 315/318, 319, 219, 201
See application file for complete search history.

(56) References Cited

U.S. PATENT DOCUMENTS

| | | | | |
|---|---|---|---|---|
| 7,956,554 | B2 * | 6/2011 | Shteynberg et al. | 315/293 |
| 7,961,113 | B2 * | 6/2011 | Rabiner et al. | 340/4.21 |
| 2010/0013396 | A1 * | 1/2010 | Peng | 315/192 |

* cited by examiner

*Primary Examiner* — Thienvu Tran
*Assistant Examiner* — Christopher Lo
(74) *Attorney, Agent, or Firm* — Muncy, Geissler, Olds & Lowe, P.C.

(57) ABSTRACT

A light emitting diode control system includes a power conversion circuit, a control circuit, and a light emitting diode emission circuit. The control circuit is configured to modulate a data signal to a modulated signal. The light emitting diode emission circuit is electrically connected in series to the control circuit through a transmission line. The light emitting diode emission circuit is adapted to receive the modulated signal outputted from the control circuit. Moreover, the light emitting diode emission circuit includes an addressing unit. The type of the addressing unit could be a pin-selection type or a burning-code type.

9 Claims, 6 Drawing Sheets

LIGHT EMITTING DIODE CONTROL SYSTEM USING MODULATED SIGNALS

This application is based on and claims the benefit of Taiwan Application No. 100224871 filed Dec. 29, 2011 the entire disclosure of which is incorporated by reference herein.

BACKGROUND OF THE INVENTION

1. Field of the Invention

The present invention relates to a light emitting diode control system, and especially relates to a light emitting diode control system using modulated signals.

2. Description of the Related Art

Nowadays, the connection types of the light emitting diode lamp string modules are separated into two types: the serial-type connection and the parallel-type connection. The light emitting diode lamp string modules are widely used for external walls of the building, decoration of trees, signboards, and scenery designing.

The related art light emitting diode lamp string modules are commonly employed to be connected in series. Also, the amount of the light emitting diode lamp string modules is determined according to the volume of the decorated objects. In addition, all of the light emitting diode lamp string modules are controlled by the same controller which initially controls the first light emitting diode lamp string module.

Although the light emitting diode lamp string modules are easily connected together, the remaining light emitting diode lamp string modules behind the abnormal light emitting diode lamp string module cannot be lighted even only one of the light emitting diode lamp string modules is abnormal. That is because the control signal cannot be sent to drive all of the remaining light emitting diode lamp string modules.

The parallel-type light emitting diode lamp string modules are connected to the controller in parallel. Accordingly, each one of the light emitting diode lamp string modules is controlled by the controller through a control line and an address line, respectively. For example, ten control lines and ten address lines need to be used when ten light emitting diode lamp string modules are employed to be connected in parallel.

The remaining light emitting diode lamp string modules can still be normally controlled when one of the light emitting diode lamp string modules is abnormal. However, the amount of the control lines and the address lines increase proportionally. Therefore, complexity and the costs of the equipment also increase when the amount of the light emitting diode lamp string modules increases.

No matter the connection type of the light emitting diode lamp string modules is the serial-type or the parallel-type, many power transmission lines and signal transmission lines need to be used to control the colors and intensities of the light emitting diode lamp string modules. Accordingly, cost down can be achieved only if the amount of the power transmission lines or the signal transmission lines can be reduced.

SUMMARY OF THE INVENTION

In order to solve the above-mentioned problems, an object of the present invention is to provide a light emitting diode control system using modulated signals.

In order to achieve the object of the present invention mentioned above, the light emitting diode control system is configured to store a computer control data in a data storage unit. The light emitting diode control system is configured to control colors and intensities of light emitting diodes with a data signal outputted from the data storage unit. The light emitting diode control system includes a power conversion circuit, a control circuit, and at least a light emitting diode emission circuit. The power conversion circuit is configured to convert an alternating current power into a direct current power. The control circuit is electrically connected to the power conversion circuit. The control circuit is adapted to receive the direct current power outputted from the power conversion circuit and is adapted to receive the data signal outputted from the data storage unit. The control circuit is configured to modulate the data signal to a modulated signal. The light emitting diode emission circuit is electrically connected in series to the control circuit through a transmission line. The light emitting diode emission circuit is adapted to receive the direct current power and the modulated signal outputted from the control circuit to vary the colors and intensities of the light emitting diodes. The control circuit includes a voltage stabilizer electrically connected to the power conversion circuit, a microcontroller electrically connected to the power conversion circuit, and a first modulation unit electrically connected to the power conversion circuit, the microcontroller, and the voltage stabilizer. The microcontroller is adapted to receive the data signal outputted from the data storage unit. The light emitting diode emission circuit includes an addressing unit, a voltage regulator, a signal acquisition unit, an amplifier, a demodulation unit, an oscillator, a filter, a recognition and logic control unit, a counting and shift registering unit, a second modulation unit, and an address register. The voltage regulator is electrically connected to the control circuit. The signal acquisition unit is electrically connected to the voltage regulator. The amplifier is electrically connected to the signal acquisition unit. The demodulation unit is electrically connected to the amplifier. The oscillator is electrically connected to the voltage regulator. The filter is electrically connected to the demodulation unit. The recognition and logic control unit is electrically connected to the filter and the addressing unit. The counting and shift registering unit is electrically connected to the recognition and logic control unit. The second modulation unit is electrically connected to the amplifier, the demodulation unit, and the recognition and logic control unit. The address register is electrically connected to the recognition and logic control unit and the addressing unit.

DETAILED DESCRIPTION OF THE INVENTION

Figure 1:
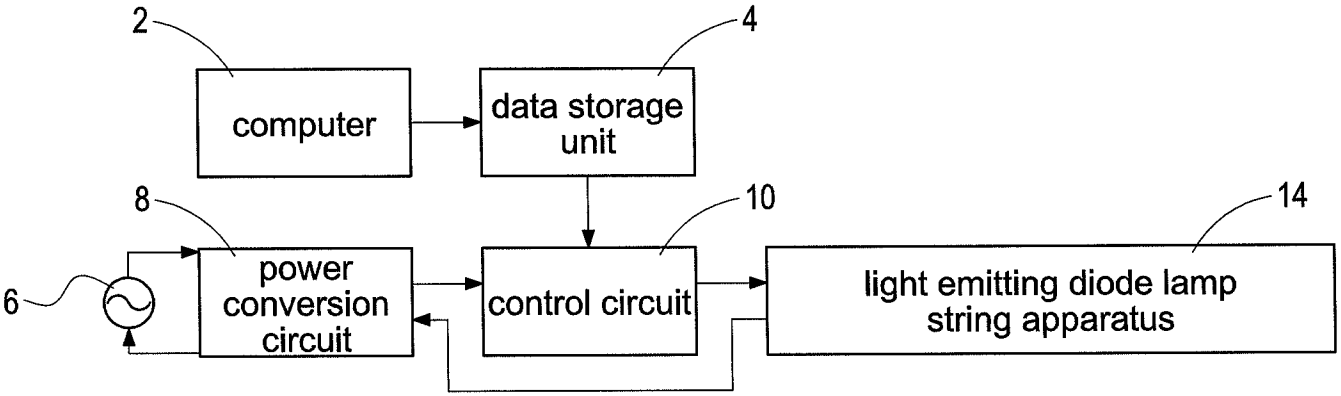
FIG. 1 shows a block diagram of the light emitting diode control system using modulated signals of the present invention.

FIG. 1 shows a block diagram of the light emitting diode control system using modulated signals of the present invention. The light emitting diode control system includes a computer 2, a data storage unit 4, an alternating current power 6, a power conversion circuit 8, a control circuit 10, and a light emitting diode lamp string apparatus 14. The computer 2 is electrically connected to the data storage unit 4. The alternating current power 6 is electrically connected to the power conversion circuit 8. The control circuit 10 is electrically connected to the data storage unit 4, the power conversion circuit 8, and the light emitting diode lamp string apparatus 14.

Figure 2:
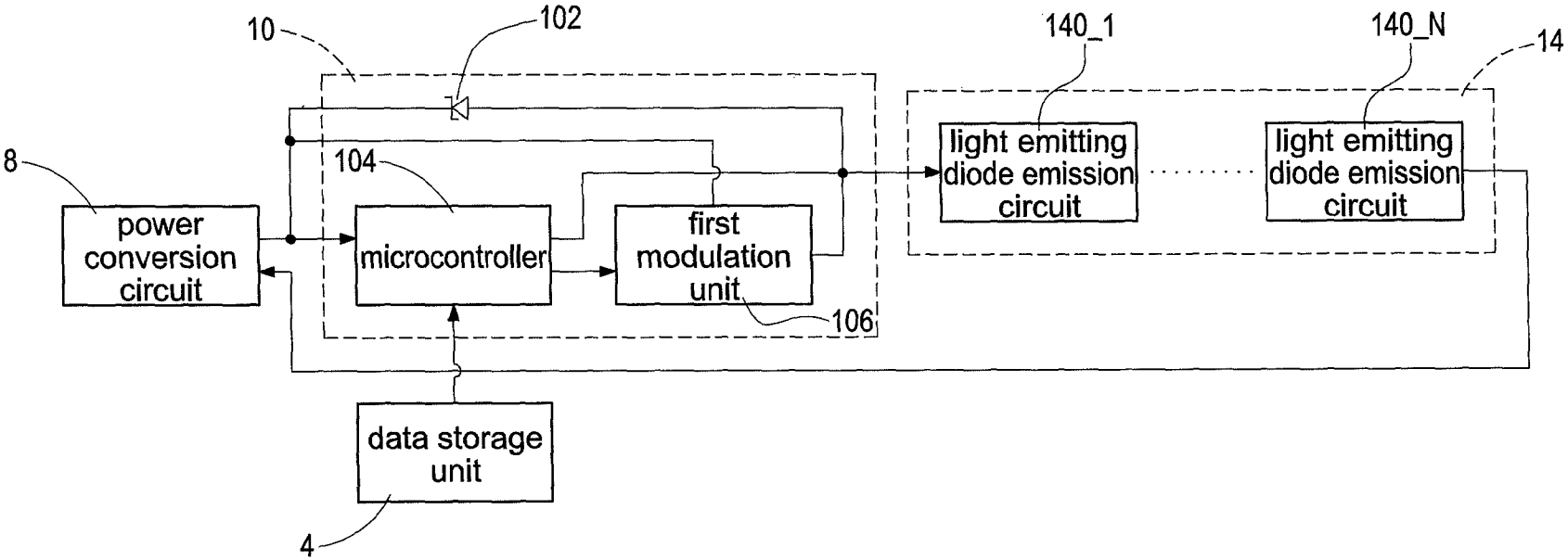
FIG. 2 shows a block diagram of the control circuit and the light emitting diode lamp string apparatus of the present invention.

The procedures of the present invention are as following. A computer control data for controlling the light emitting diode lamp string apparatus 14 is stored in the data storage unit 4 by a user using the computer 2. The computer control data is sent from the data storage unit 4 to the control circuit 10 to control the color and intensity of the light emitting diode lamp string apparatus 14. A data signal is sent from the data storage unit 4 to the control circuit 10. The control circuit 10 is configured to modulate the data signal to a modulated signal. The modulated signal is advantageous for signal transmission. The alternating current power 6 (such as a 110-volt wall socket power) is converted into a direct current power (such as a 110-volt direct current power) by the power conversion circuit 8 after the alternating current power 6 is received by the power conversion circuit 8. The control circuit 10 and the light emitting diode lamp string apparatus 14 are driven by the direct current power. The direct current power is sent from the power conversion circuit 8 to the control circuit 10 and the light emitting diode lamp string apparatus 14 through the same transmission line which is used to send the modulated signal to the light emitting diode lamp string apparatus 14. FIG. 2 shows a block diagram of the control circuit and the light emitting diode lamp string apparatus of the present invention. The control circuit 10 includes a voltage stabilizer 102 (for example, a voltage stabilizing diode), a microcontroller 104, and a first modulation unit 106. The microcontroller 104 is electrically connected to the data storage unit 4, the voltage stabilizer 102, the power conversion circuit 8, the first modulation unit 106, and the light emitting diode lamp string apparatus 14.

The first modulation unit 106 is electrically connected to the voltage stabilizer 102, the power conversion circuit 8, the microcontroller 104, and the light emitting diode lamp string apparatus 14. The light emitting diode lamp string apparatus 14 includes a plurality of light emitting diode emission circuits 140_1~140_N. The light emitting diode emission circuits 140_1~140_N will be collectively represented with numeral 140 hereafter. The light emitting diode emission circuits 140 are electrically connected in series, and one terminal of the first light emitting diode emission circuit 140_1 is electrically connected to the voltage stabilizer 102, the microcontroller 104, and the first modulation unit 106.

The operation relations between the control circuit 10 and the light emitting diode lamp string apparatus 14 are as following. The power conversion circuit 8 is configured to send the direct current power (such as a 110-volt direct current power). The voltage stabilizer 102 is configured to supply the driving direct current voltage to the microcontroller 104 and the first modulation unit 106. The data signal is sent from the microcontroller 104 to the first modulation unit 106 after the data signal is sent from the data storage unit 4 to the microcontroller 104. The first modulation unit 106 is configured to modulate the data signal to the modulated signal. The modulated signal is sent with the same transmission line which is used to send the electric power to the light emitting diode lamp string apparatus 14. The first light emitting diode emission circuit 140_1 receives the direct current power and the modulated signal sent from the control circuit 10 to light the corresponding light emitting diodes. Afterward, the direct current power and the modulated signal are sent to the next light emitting diode emission circuit 140 (namely, the second light emitting diode emission circuit 140_2).

Figure 3:
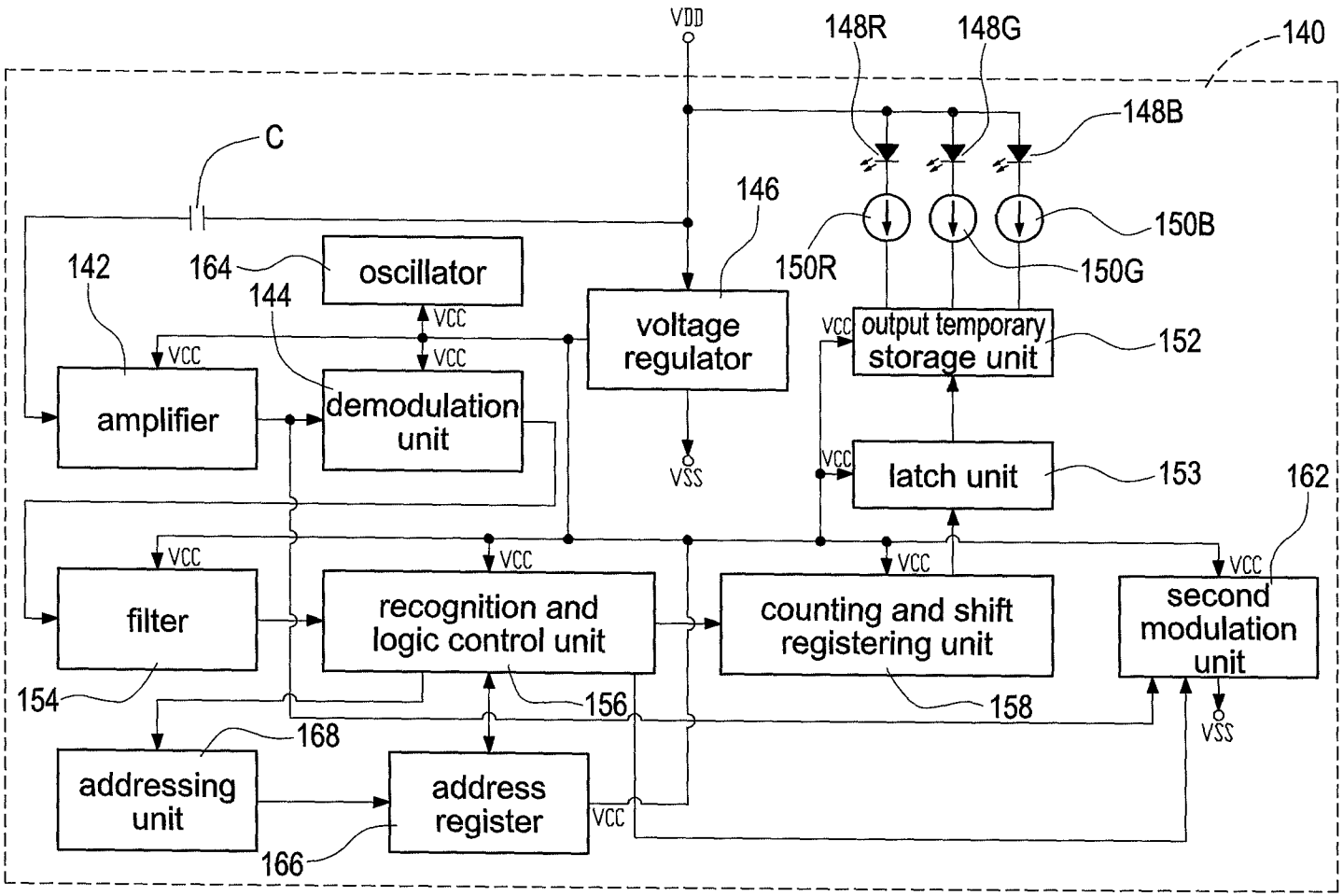
FIG. 3 shows a block diagram of the light emitting diode emission circuit of the present invention.

FIG. 3 shows a block diagram of the light emitting diode emission circuit of the present invention. The light emitting diode emission circuit 140 includes a signal acquisition unit C (for example, a capacitor), an amplifier 142, a demodulation unit 144, a voltage regulator 146, a red light emitting diode 148R, a green light emitting diode 148G, a blue light emitting diode 148B, a first constant current source 150R, a second constant current source 150G, a third constant current source 150B, an output temporary storage unit 152, a latch unit 153, a filter 154, a recognition and logic control unit 156, a counting and shift registering unit 158, a second modulation unit 162, an oscillator 164, an address register 166, and an addressing unit 168.

For the first light emitting diode emission circuit 140_1, a VDD terminal is where the direct current power and the modulated signal are sent from the control circuit 10. For the second light emitting diode emission circuit 140_2, the VDD terminal is where the direct current power and the modulated signal are sent from the first light emitting diode emission circuit 140_1. For the remaining light emitting diode emission circuits 140_3~140_N, the VDD terminal is where the direct current power and the modulated signal are sent from.

For the first light emitting diode emission circuit 140_1, a VSS terminal is where the direct current power and the modulated signal are sent to the second light emitting diode emission circuit 140_2. For the second light emitting diode emission circuit 140_2, the VSS terminal is where the direct current power and the modulated signal are sent to the third light emitting diode emission circuit 140_3. For the remaining light emitting diode emission circuits 140_3~140_N, the VSS terminal is where the direct current power and the modulated signal are sent to. In another word, the VDD terminal is an input terminal and the VSS terminal is an output terminal for each of the light emitting diode emission circuits 140. Moreover, a VCC terminal is where the direct current voltage is outputted from the voltage regulator 146 and is where the direct current voltage is inputted to the above-mentioned units.

More specifically, the VDD terminal is electrically connected to the VSS terminal though the voltage regulator 146. The VDD terminal is electrically connected to the amplifier 142 through the signal acquisition unit C. The VDD terminal is electrically connected to the first constant current source 150R through the red light emitting diode 148R. The VDD terminal is electrically connected to the second constant current source 150G through the green light emitting diode 148G. The VDD terminal is electrically connected to the third constant current source 150B through the blue light emitting diode 148B. The oscillator 164 is electrically connected to the voltage regulator 146.

The filter 154 is electrically connected to the amplifier 142 through the demodulation unit 144. The counting and shift registering unit 158 is electrically connected to the filter 154 through the recognition and logic control unit 156. The counting and shift registering unit 158 is electrically connected to the output temporary storage unit 152 through the latch unit 153. The output temporary storage unit 152 is electrically connected to the first constant current source 150R, the second constant current source 150G, and the third constant current source 150B. The second modulation unit 162 is electrically connected to the VSS terminal, the amplifier 142, the demodulation unit 144, and the recognition and logic control unit 156. The address register 166 is electrically connected to the recognition and logic control unit 156. The addressing unit 168 is electrically connected to the recognition and logic control unit 156 and the address register 166.

The operation procedures of the light emitting diode emission circuit 140 are explained as following. The signal acquisition unit C (such as a capacitor) is adapted to block the direct current voltage in the VDD terminal to enter into the amplifier 142 and other units which are configured to process the alternating current signals. The modulated signal can only pass through the signal acquisition unit C. The direct current voltage in the VDD terminal is inputted into the voltage regulator 146 to generate a direct current voltage VCC2 outputted from a VCC terminal. The direct current voltage VCC2 is supplied to drive other units.

The direct current power is sent from the VSS terminal of the voltage regulator 146 to the VDD terminal of the next light emitting diode emission circuit 140. A direct current component of the modulated signal sent from the VDD terminal is blocked by the signal acquisition unit C, and an alternating current component of the modulated signal is passed by the signal acquisition unit C. The alternating current component of the modulated signal is amplified by the amplifier. The amplified modulated signal (only the alternating current component) is demodulated by the demodulation unit 144.

The demodulated signal is restored to the original signal by the filter 154. Afterward, the original signal is recognized to separate the data contents and clock, and the data contents are shifted in the counting and shift registering unit 158. After a number of signals are sent, the data contents of the counting and shift registering unit 158 are latched to the output temporary storage unit 152 by the latch unit 153 when a defaulted end signal is received.

The colors and intensities of the red light emitting diode 148R, the green light emitting diode 148G, and the blue light emitting diode 148B are performed according to the data contents. Afterward, the data contents are sent to the second modulation unit 162 to be modulated into a modulated signal. The modulated signal is sent to the next light emitting diode emission circuit 140 through the VSS terminal. More particularly, the first constant current source 150R, the second constant current source 150G, and the third constant current source 150B are configured to provide the constant current and receive the data contents outputted from the output temporary storage unit 152.

The addressing unit 168 is configured to address the light emitting diode emission circuits 140. There are two types for the addressing as following.

1. Pin-selection type: Some pins of the driver IC of the lamp are preserved and selected for addressing. The addressing unit 168 includes plural address setting pins. This type is easy and suitable for fewer lamps.

2. Burning-code type: The burning-code type is achieved by applying voltages different from the working voltage, or by applying special codes or lights. Different IDs will be burned into different lamps. Therefore, a memory (for examples, a poly-fuse, a laser cut, an EPROM, an EEPROM, or a flash ROM) will be included in the lamp. The memory is re-burnable if the addressing has errors.

Figure 4:
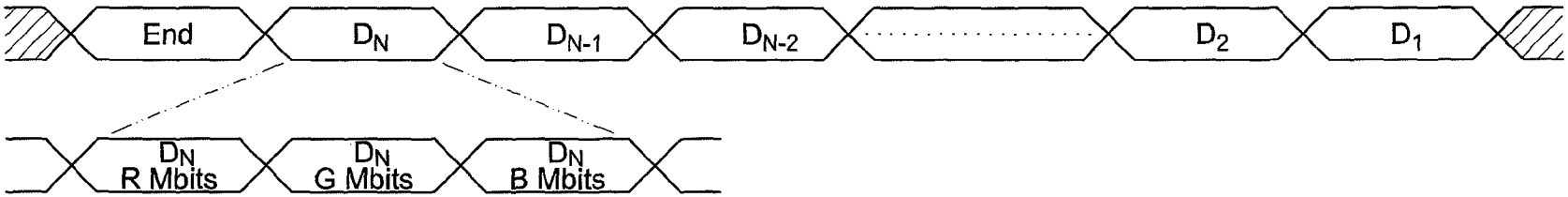
FIG. 4 shows a timing sequence diagram of communicating the modulated signals between the light emitting diode emission circuits.

FIG. 4 shows a timing sequence diagram of communicating the modulated signals between the light emitting diode emission circuits. The lower part of FIG. 4 shows the modulated signal which is sent to the Nth light emitting diode emission circuit 140_N. Also, the sequence of the colors is not limited as shown in FIG. 4. As mentioned above, the data contents of the counting and shift registering unit 158 are latched to the output temporary storage unit 152 through the latch unit 153 to control the colors and intensities of the light emitting diodes when the defaulted end signal END is received. Moreover, the modulated signal (shown in FIG. 4) can be sent from the xth light emitting diode emission circuit 140_$x$ to the next light emitting diode emission circuit 140_($x$+1).

Figure 5:
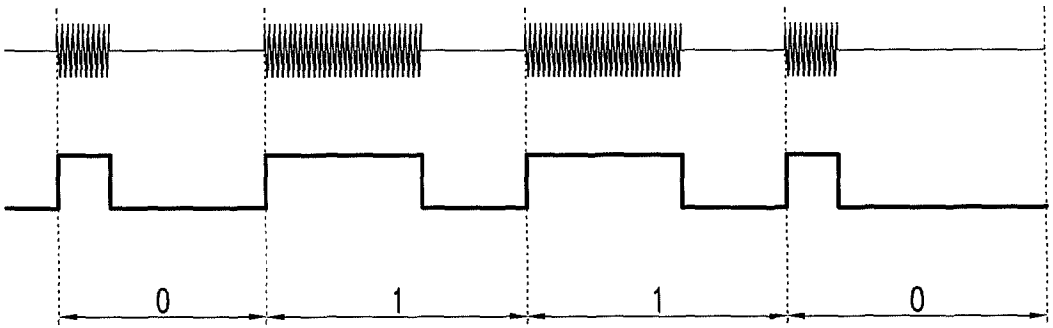
FIG. 5 shows a waveform diagram of the modulated signals (upper part) and the data signal (lower part).
Figure 6A:
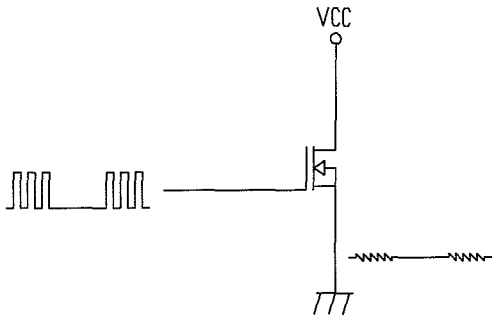
FIG. 6A shows a circuit diagram of an embodiment of the modulation unit.
Figure 6B:
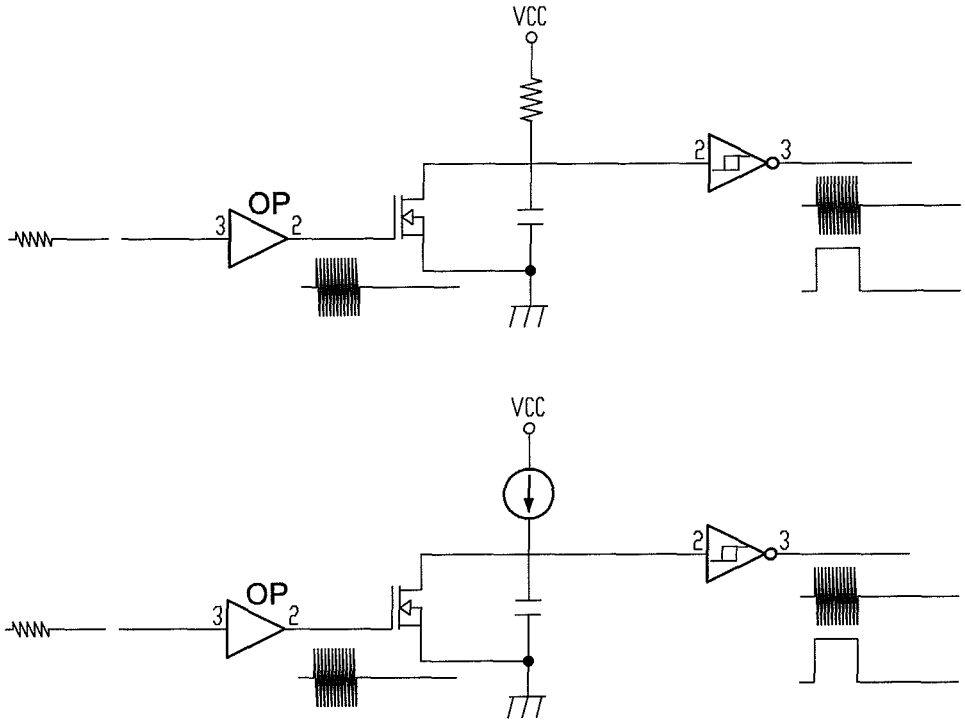
FIG. 6B shows a circuit diagram of an embodiment of the demodulation unit.

FIG. 5 shows a waveform diagram of the modulated signals (upper part) and the data signal (lower part). A sequence (0, 1, 1; 0) of the digital signal can be sent through the pulse width modulation (PWM) scheme. Also, the data signal can be modulated to generate the modulated signal. FIG. 6A shows a circuit diagram of an embodiment of the modulation unit. FIG. 6B shows a circuit diagram of an embodiment of the demodulation unit.

Figure 7:
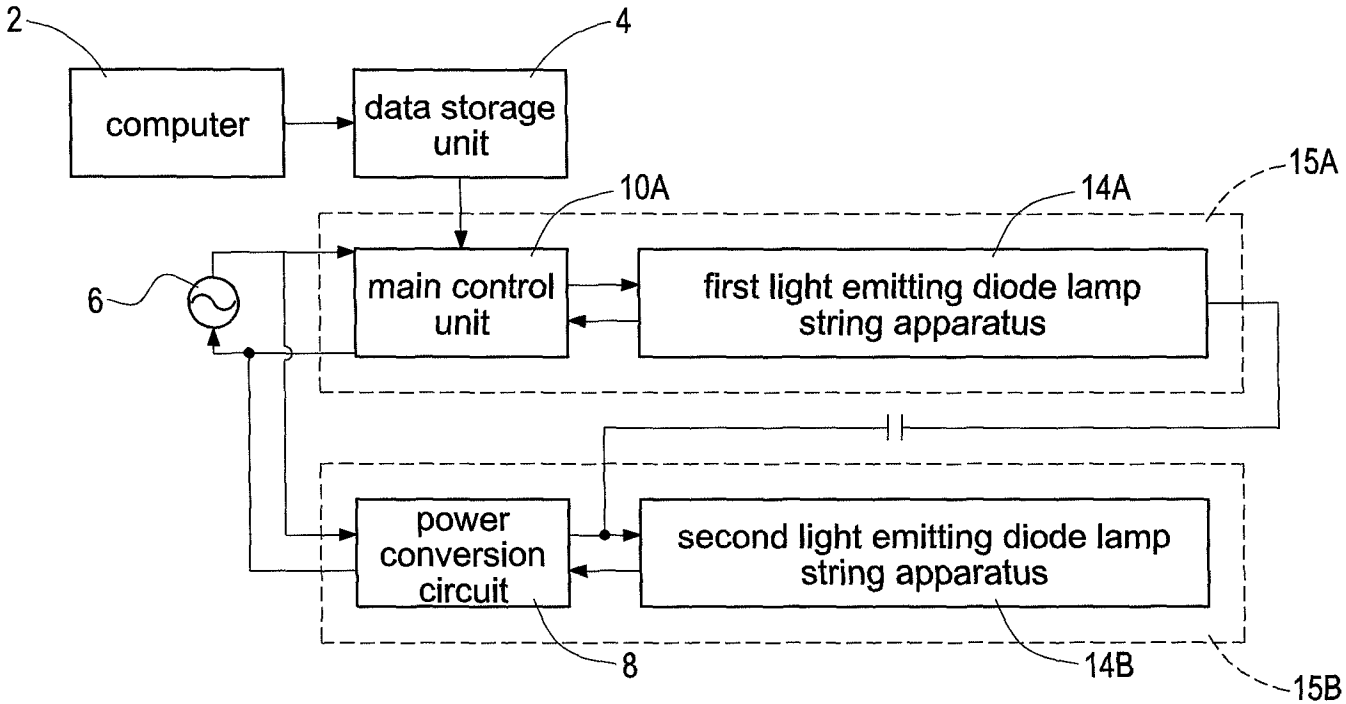
FIG. 7 shows a block diagram of another embodiment of the light emitting diode control system using the modulated signals of the present invention.

FIG. 7 shows a block diagram of another embodiment of the light emitting diode control system using the modulated signals of the present invention. The above-mentioned power conversion circuit 8 and the control circuit 10 can be integrated into a main control unit 10A. A first light emitting diode lamp string 15A includes the control unit 10A and a first light emitting diode lamp string apparatus 14A. A second light emitting diode lamp string 15B includes the power conversion circuit 8 and a second light emitting diode lamp string apparatus 14B. The modulated signal generated by the main control unit 10A can be sent to the first light emitting diode lamp string apparatus 14A and the second light emitting diode lamp string apparatus 14B. The power conversion circuit 8 is configured to provide the required power to the second light emitting diode lamp string apparatus 14B. Accordingly, more light emitting diodes can be simultaneously controlled. It assumes that a voltage drop across each of the light emitting diode emission circuits 140 is 4 volts. Hence, there are about 27 light emitting diode emission circuits 140 can be driven and controlled in the embodiment as shown in FIG. 1. There are about 54 light emitting diode emission circuits 140 can be driven and controlled in the embodiment as shown in FIG. 7.

Moreover, a part of or all of the components of the light emitting diode emission circuit 140 (except the red light emitting diode 148R, the green light emitting diode 148G, and the blue light emitting diode 148B) can be integrated into an integrated circuit (IC). The integrated circuit and the light emitting diode chips (the red light emitting diode 148R, the green light emitting diode 148G, and the blue light emitting diode 148B) can further be integrated into a light emitting diode lamp.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A light emitting diode control system using modulated signals, the light emitting diode control system configured to store a computer control data in a data storage unit and configured to control colors and intensities of light emitting diodes with a data signal outputted from the data storage unit, the light emitting diode control system including:

a power conversion circuit configured to convert an alternating current power into a direct current power;

a control circuit electrically connected to the power conversion circuit, the control circuit receiving the direct current power outputted from the power conversion circuit and receiving the data signal outputted from the data storage unit, the control circuit configured to modulate the data signal to a modulated signal; and at least a light emitting diode emission circuit electrically connected in series to the control circuit through a transmission line, the light emitting diode emission circuit receiving the direct current power and the modulated signal outputted from the control circuit and configured to vary the colors and intensities of the light emitting diodes, wherein the control circuit includes:

a voltage stabilizer electrically connected to the power conversion circuit;

a microcontroller electrically connected to the power conversion circuit, the microcontroller receiving the data signal outputted from the data storage unit; and a first modulation unit electrically connected to the power conversion circuit, the microcontroller, and the voltage stabilizer, wherein the light emitting diode emission circuit includes:

an addressing unit;

a voltage regulator electrically connected to the control circuit;

a signal acquisition unit electrically connected to the voltage regulator;

an amplifier electrically connected to the signal acquisition unit;

a demodulation unit electrically connected to the amplifier;

an oscillator electrically connected to the voltage regulator;

a filter electrically connected to the demodulation unit;

a recognition and logic control unit electrically connected to the filter and the addressing unit;

a counting and shift registering unit electrically connected to the recognition and logic control unit;

a second modulation unit electrically connected to the amplifier, the demodulation unit, and the recognition and logic control unit; and an address register electrically connected to the recognition and logic control unit and the addressing unit, wherein the addressing unit is configured to address the light emitting diode emission circuit; the addressing unit is applied to a voltage different from a working voltage of the addressing unit for addressing the light emitting diode emission circuit; identification for addressing the light emitting diode emission circuit is burned into the addressing unit.

2. The light emitting diode control system in claim 1, wherein the light emitting diode emission circuit further includes:

a latch unit electrically connected to the counting and shift registering unit; and an output temporary storage unit electrically connected to the latch unit.

3. The light emitting diode control system in claim 2, wherein the light emitting diode emission circuit further includes:

at least a constant current source electrically connected to the output temporary storage unit.

4. The light emitting diode control system in claim 3, wherein the light emitting diode emission circuit further includes:

at least a light emitting diode electrically connected to the constant current source.

5. The light emitting diode control system in claim 4, wherein the addressing unit includes a plurality of address setting pins.

6. The light emitting diode control system in claim 5, wherein the addressing unit includes a memory.

7. The light emitting diode control system in claim 6, wherein the signal acquisition unit is a capacitor.

8. The light emitting diode control system in claim 7, wherein except the light emitting diode, the light emitting diode emission circuit is integrated into an integrated circuit.

9. The light emitting diode control system in claim 8, wherein the integrated circuit and the light emitting diode are integrated into a light emitting diode lamp.

* * * * *